United States Patent [19]

Cullom

[11] 4,208,870

[45] Jun. 24, 1980

[54] CLOCK-ORIENTED VISUAL REMINDER AND METHOD

[76] Inventor: Edward N. Cullom, 611 Mabry Rd., Atlanta, Ga. 30328

[21] Appl. No.: 925,277

[22] Filed: Jul. 17, 1978

[51] Int. Cl.[2] ..... G04B 19/06

[52] U.S. Cl. ..... 368/41 R; 368/232

[58] Field of Search ..... 58/127 R, 127 A, 127 B, 58/126 R, 126 D, 148, 149, 150, 151, 152 R, 56, 91, 53, 54, 55; 40/600, 621

[56] References Cited

U.S. PATENT DOCUMENTS

| | | | |
|---|---|---|---|
| 907,294 | 12/1908 | Scott | 58/150 |
| 927,007 | 7/1909 | Scritchfield | 58/151 |
| 1,522,449 | 1/1925 | Hartson | 58/151 |
| 1,533,297 | 4/1925 | Aller | 58/151 X |
| 1,887,303 | 11/1932 | Grossman | 58/150 |
| 2,253,715 | 8/1941 | Lux | 58/127 R X |
| 2,628,469 | 2/1953 | Morrow | 58/56 X |
| 2,718,113 | 9/1955 | Bramwell | 58/151 |
| 3,118,207 | 1/1964 | Breslow | 40/621 X |
| 3,228,133 | 1/1966 | Baermann | 40/621 |
| 3,307,346 | 3/1967 | Klingenberg | 58/91 |

*Primary Examiner*—Ulysses Weldon

*Attorney, Agent, or Firm*—Hill, Van Santen, Steadman, Chiara & Simpson

[57] ABSTRACT

For reminding a viewer that a predetermined action should be effected at a particular time, means such as a pill bucket, medication spoon, or the like, is adapted to be removeably supported at a fixed time indicator with respect to which time indexing means are regularly moveable relative to the indicator.

8 Claims, 5 Drawing Figures

CLOCK-ORIENTED VISUAL REMINDER AND METHOD

This invention relates to a new and improved clock-oriented visual reminder and method, and is especially useful for reminding when medication, vitamins, or the like, should be taken by a particular individual.

Many persons are required to take, or desirably should take medication, vitamins, or the like, at predetermined intervals during the day. Some persons must take several kinds of medications at different hours during the day. Some of the medication may be liquid, and some in pill form. The same is true with respect to vitamins or minerals that may have been prescribed or which a person may voluntarily wish to take at certain time or times during the day.

Various and sundry devices have been proposed for timed medication dispensing or signaling, or combinations thereof, but in general, prior proposals have involved complex, special mechanisms and procedures and have been costly to produce and therefore involve greater cost to the user than may sometimes, at least, be warranted.

It is therefore an important object of the present invention to provide a new and improved clock-oriented visual reminder and method, which will overcome the disadvantages, drawbacks, inefficiencies, shortcomings and problems inherent in prior arrangements.

In an embodiment of the invention, there is provided in combination with a clock having at least one fixed time indicator, time indexing means regularly moveable relative to the indicator, articles supporting means located at the indicator, and article means adapted to be removeably supported by the supporting means for reminding a viewer that a predetermined action should be effected when the indexing means registers with the indicator.

The present invention also provides a method of reminding a viewer of a clock face having at least one fixed time indicator and time indexing means regularly moveably driven relative to the indicator, that a predetermined action should be effected, comprising locating article supporting means on the clock face at the indicator, and removeably supporting on the supporting means article means for reminding the viewer that the predetermined action should be effected when the indexing means registers with the indicator.

Other objects, features and advantages of the invention will be readily apparent from the following description of representative embodiments thereof, taken in conjunction with the accompanying drawing although variations and modifications maybe effected without departing from the spirit and scope of the novel concepts embodied in the disclosure and in which.

Figure 1:
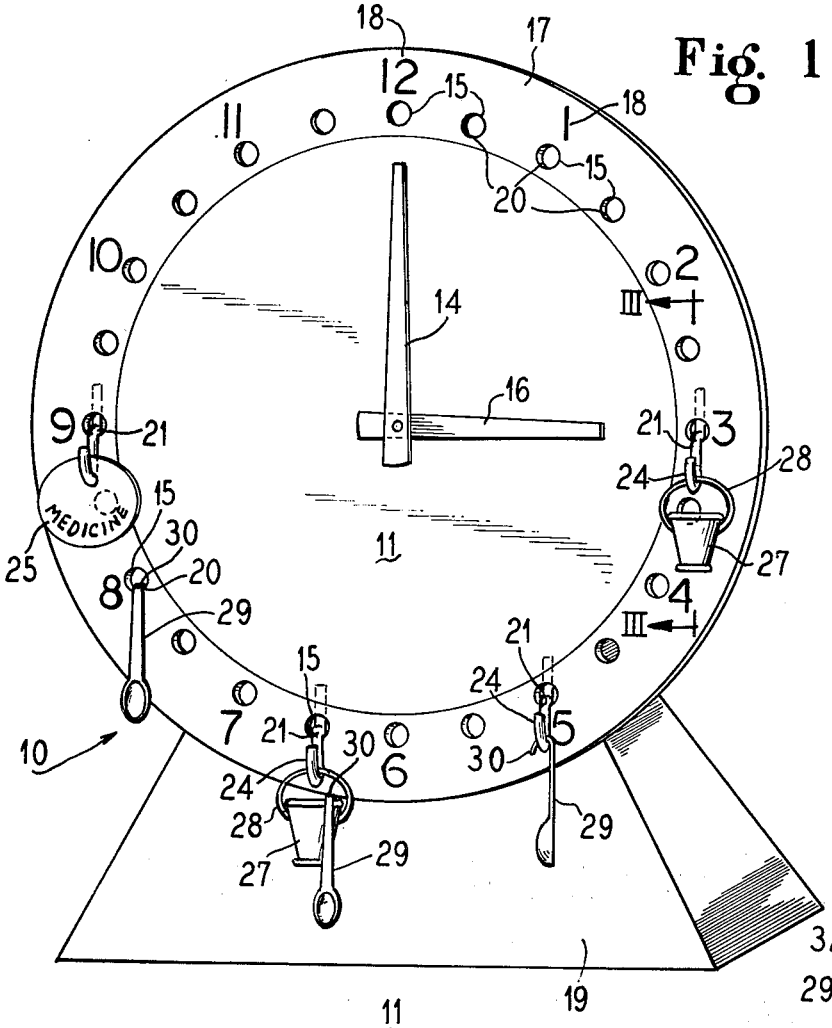
FIG. 1 is an isometric view of a clock embodying the invention.
Figure 3:
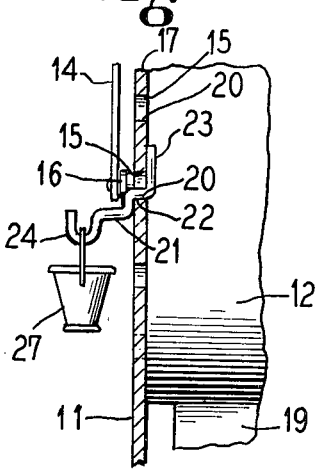
FIG. 3 is a fragmentary sectional detail view taken substantially along the line III—III of FIG. 1.
Figure 2:
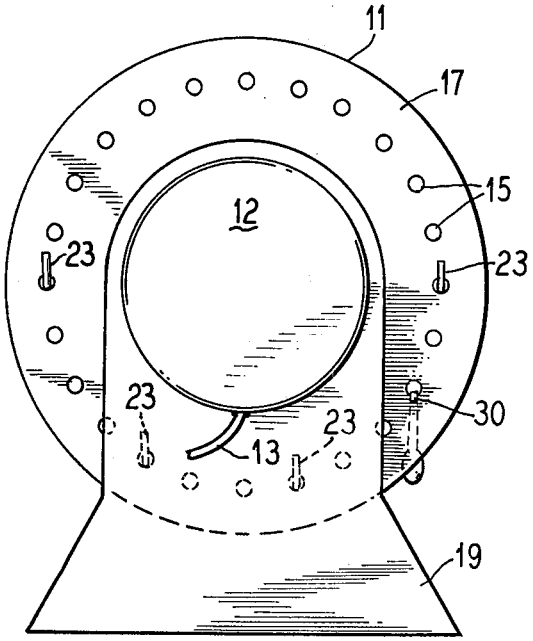
FIG. 2 is a reduced size rear view of the clock of FIG. 1.

In one preferred embodiment of the invention, a clock 10 (FIGS. 1 and 2) has a face 11, at the back of which is a clock mechanism (not shown) within a housing 12. The clock mechanism may be of any preferred form, either mechanical or electrical, and because such mechanisms are quite well known need not be specifically illustrated. Where the clock mechanism 12 is electrical, a source of electrical power may be connected to it by means of an electrical cord 13 as is customary. Time indexing means which may comprise one or more conventional hands such as an hour hand 13 and a minute hand 14 are operatively connected with the clock mechanism in the usual manner and to the usual effect. That is, the hands 16 and 14 are adapted to move regularly clockwise relative to one or more indicators, which may be of any preferred form but in a desirable arrangement, comprise a spot, in this instance, in the form of a hole 15 adjacent the perimeter of the face 11 and located at the desired time indicating position. For example, the holes may be provided in an annular equally spaced set or series in an annular area 17 and located at half hourly intervals throughout a 12 hour span. If desired, auxiliary time indicators in the form of numerals 18 may be associated with the time indicator holes 15 at the hourly positions on the annular area 17. As a convenience in providing the time indicators, the clock face may comprise a disk panel. Although the clock 10 may be of the wall hanging type, it may be, as shown, provided with a supporting stand 19 of any preferred form to maintain the clock in a stable supported relation on a table, dresser, nightstand, or the like.

Article supporting means are located at the indicator holes 15 in the form of respective ledges 20 at the lower sides of the edges defining the indicator holes 15. This provides the capability of hanging article means on the clock face 11 in removeably supported relation for reminding a viewer that a predetermined action should be effected when the indexing means, i.e., the hour hand 16 and or the minute hand 14, align with the selected fixed time indicator 15 and/or 18. The article means to be supported by the selected ledge or ledges 20 may assume various forms suitable to remind the viewer of the action to be taken. One such reminder device comprises a hook structure 21 which may be in the form of a pegboard hook having an angular shoulder 22 for engagement with the ledge 20 of any selected of the indicator holes 15, the hook having a rear upstanding finger 23 for engaging the back of the board above the selected hole 15, and a forwardly projecting portion providing an upwardly facing hook 24. Whereas the hook 24 may support a reminder hang up tag 25 having any suitable reminder legend thereon, it may also support a container 27 for a medication dose, vitamin or mineral supplement, or the like, which a viewer should take at a particular time selectively indicated by the hourly or half hourly position at which the reminder device is placed on the clock face panel board. For convenience the bucket 27 in each instance may be provided with a bail 28 for engagement on the hook 24. Another form of reminder device may comprise an actual or simulated spoon 29 having a hook 30 by which it is adapted to be engaged upon hook 24 of the peg 21, or the spoon may be directly engaged upon the selected fixed indicator ledge 20. Where applicable, for the convenience of the user, the spoon 29 may be hung by its suspension hook 30 on the rim of one of the bucket-like containers 27. In whatever form the reminder device may take or in whatever manner it may be displayed in relation to the clock 11, it provides a convenient, low cost means to assist the viewer in remembering when to take the predetermined action for which the reminder device is intended. This is especially important for persons on strict medication requirements. The buckets 27 or spoons 29, or tags 25, may be placed at any of one or more time of day locations the medication is to be taken. The person involved or an attendant may place the proper pills in the bucket or buckets 27. If a liquid medication is to be taken with the pills, the spoon 29 is hung on the bucket 27 at the proper time location. If only liquid medication is to be taken, the spoon alone is hung at the proper time location.

It may be noted that an advantage of using the pegboard hooks 21 is that the bucket containers 27 or spoon 29 when hung along the upper portion of the area 17 will be spaced outwardly sufficiently from the clock face 11 to avoid interference with the sweep of the time indexing hands 16 and 14, and especially the minute hand 14, thereby since such hands are thus enabled to pass behind the hanging reminder device.

Figure 5:
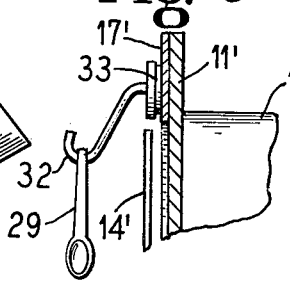
FIG. 5 is a fragmentary vertical sectional elevational detail view taken substantially along the line V—V of FIG. 4.
Figure 4:
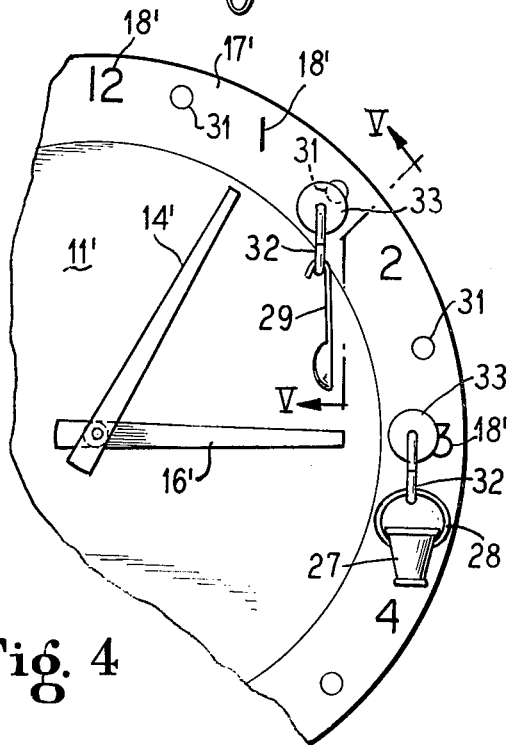
FIG. 4 is a fragmentary front elevational view of a clock face showing a modification.

In another desirable form, the peripheral area 17' (FIGS. 4 and 5) of the clock face 11' may be of magnetized or magnetic material on which the fixed time indicator or indicators 18' are in the form of hourly numerals and half hour spots 31. In this instance, reminder device hooks 32 are provided with respective magnet or magnetic bases 33 by means of which the hooks are adapted to be placed removeable at any preferred time location on the area 17'. For example, one of the hooks 32 is shown in FIG. 4 as located at one of the half hour spots 31. On the other hand, one of the buckets 27 is shown as hung on one of the hooks 32 which is located at one of the hour indicators. In either instance, when the hour hand 16' indexes with the location of the hook 32 for the spoon 29 or the container 27, the viewer will be reminded of the predetermined action that should be effected, such as taking medication, vitamin, or mineral supplement, or the like.

From the foregoing it will be apparent that the present invention provides a simple versatile, low cost, efficient clock-oriented visual reminder and method.

It will be understood that variations and modifications may be effected without departing from the spirit and scope of the novel concepts of this invention.

I claim as my invention:

1. In combination with a clock having a face provided about its perimeter with an annular area carrying an annular series of fixed time indicators, and time indexing sweep hand means regularly sweeping along the inner diameter of said annular area:

upwardly opening hook means and means for mounting said hook means on said annular area selectively at said time indicators;

and means replaceably supported on said hook means and liable to extend inwardly beyond said inner diameter;

said hook means projecting sufficiently outwardly relative to the sweep path of said sweep hand means to support said replaceably supported means in clearance relation to said clock face and said sweep path to permit free sweeping of said sweep hand means between said supported means and said clock face;

said replaceably supported means comprising a tag carried on said hook means.

2. A method of reminding a viewer of a clock face provided about its perimeter with an annular area carrying an annular series of fixed time indicators, and time indexing sweep hand means regularly sweeping along the inner diameter of said annular area, that a predetermined action should be effected, comprising:

applying mounting means of upwardly opening hook means on said annular area selectively at said time indicators;

replaceably supporting on said hook means a means liable to extend inwardly beyond said inner diameter;

effecting projection of said hook means sufficiently outwardly relative to the sweep path of said sweep hand means to support said replaceably supported means in clearance relation to said clock face and said sweep path;

and permitting the sweep hand means to sweep between said supported means and said clock face where said supported means extends inwardly beyond said inner diameter;

and said replaceably supported on said hook means a means liable to extend inwardly beyond said inner diameter comprising supporting a tag on said hook means.

3. In combination with a clock having a face provided about is perimeter with an annular area carrying an annular series of fixed time indicators, and time indexing sweep hand means regularly sweeping along the inner diameter of said annular area:

upwardly opening hook means and means for mounting said hook means on said annular area selectively at said time indicators;

and a spoon replaceably supported on said hook means and liable to extend inwardly beyond said inner diameter;

said hook means projecting sufficiently outwardly relative to the sweep path of said sweep hand means to support said spoon in clearance relation to said clock face and said sweep path to permit free sweeping of said sweep hand means between said spoon and said clock face.

4. In a combination with a clock having a face provided about its perimeter with an annular area carrying an annular series of fixed time indicators, and time indexing sweep hand means regularly sweeping along the inner diameter of said annular area:

upwardly opening hook means and means for mounting said hook means on said annular area selectively at said time indicators;

and a bucket replaceably supported on said hook means and liable to extend inwardly beyond said inner diameter;

said bucket being adapted to serve as a container for a substance to be taken by a person at the time indicated by the selected indicator at which the hook means has been placed;

said hook means projecting sufficiently outwardly relative to the sweep path of said sweep hand means to support said bucket in clearance relation to said clock face and said sweep path to permit free sweeping of said sweep hand means between said bucket and said clock face.

5. A combination according to claim 4, including a spoon having a hook-shaped handle engaged on said bucket to enhance the convenience of said supported means.

6. A method of reminding a viewer of a clock face provided about its perimeter with an annular area carrying an annular series of fixed time indicators, and time indexing sweep hand means regularly sweeping along the inner diameter of said annular area, that a predetermined action should be effected, comprising:

applying mounting means of upwardly opening hook means on said annular area selectively at said time indicators;

replaceably supporting on said hook means a spoon liable to extend inwardly beyond said inner diameter;

effecting projection of said hook means sufficiently outwardly relative to the sweep path of said sweep hand means to support said spoon in clearance relation to said clock face and said sweep path;

and permitting the sweep hand means to sweep between said spoon and said clock face where said spoon extends inwardly beyond said inner diameter.

7. A method of reminding a viewer of a clock face provided about its perimeter with an annular area carrying an annular series of fixed time indicators, and time indexing sweep hand means regularly sweeping along the inner diameter of said annular area, that a predetermined action should be effected, comprising:

applying mounted means of upwardly opening hook means on said annular area selectively at said time indicators;

replaceably supporting on said hook means a bucket liable to extend inwardly beyond said inner diameter;

effecting projection of said hook means sufficiently outwardly relative to the sweep path of said sweep hand means to support said bucket in clearance relation to said clock face and said sweep path;

placing in said bucket material to be consumed by a person at the time interval of the selective indicator at which the bucket means is located;

and permitting the sweep hand means to sweep between said bucket and said clock face where said bucket extends inwardly beyond said inner diameter.

8. A method according to claim 7, which comprises suspending a hook handle spoon from said bucket means to facilitate taking of said material by the intended person.

* * * * *

UNITED STATES PATENT AND TRADEMARK OFFICE

CERTIFICATE OF CORRECTION

PATENT NO. : 4,208,870

DATED : June 24, 1980

INVENTOR(S) : Edward N. Cullom

It is certified that error appears in the above-identified patent and that said Letters Patent are hereby corrected as shown below:

Column 1, line 12, for "medications" read --medication--.

Column 1, line 55, for "maybe" read --may be--.

Column 3, line 2, for "clock 11" read --clock face 11--.

Column 4, line 22, for "supported" read --supporting--.

Column 4, line 27, for "is" read --its--.

Column 6, line 3, for "mounted" read --mounting--.

Signed and Sealed this

*Twenty-third* Day of *June 1981*

[SEAL]

*Attest:*

RENE D. TEGTMEYER

*Attesting Officer*

*Acting Commissioner of Patents and Trademarks*